United States Patent [19]

Thompson, Jr.

[11] Patent Number: 4,610,115

[45] Date of Patent: Sep. 9, 1986

[54] MULTIPLE-GLAZED COMBINATION VISION AND SPANDREL ARCHITECTURAL PANEL AND CURTAINWALL

[75] Inventor: Albert E. Thompson, Jr., New Kensington, Pa.

[73] Assignee: PPG Industries, Inc., Pittsburgh, Pa.

[21] Appl. No.: 682,134

[22] Filed: Dec. 17, 1984

[51] Int. Cl.[4] ..... E04C 2/54; E06B 7/12

[52] U.S. Cl. ..... 52/171; 52/235; 52/788; 52/812; 350/259; 428/34

[58] Field of Search ..... 52/171, 235, 788, 786, 52/812; 350/259, 260, 261, 262, 263, 264; 428/34

[56] References Cited

U.S. PATENT DOCUMENTS

| | | | |
|---|---|---|---|
| Re. 30,432 | 11/1980 | Stoakes | 52/235 |
| 2,566,346 | 9/1951 | Lytle et al. | 428/336 |
| 2,866,527 | 12/1958 | Schilling | 52/235 |
| 3,081,200 | 3/1963 | Tompkins | 427/129 |
| 3,107,177 | 10/1963 | Saunders et al. | 427/110 |
| 3,185,586 | 5/1965 | Saunders et al. | 428/432 |
| 3,202,054 | 8/1965 | Mochel | 427/160 |
| 3,638,385 | 2/1972 | Nobels et al. | 52/235 |
| 3,660,061 | 5/1972 | Donley et al. | 428/432 |
| 3,869,198 | 3/1975 | Ballentine | 350/259 |
| 3,951,525 | 4/1976 | Ballentine . | |
| 4,000,593 | 1/1977 | Cypher | 52/172 |
| 4,233,796 | 11/1980 | Mazzoni et al. . | |
| 4,291,511 | 9/1981 | Stoakes | 52/235 |
| 4,302,503 | 11/1981 | Mattimoe . | |
| 4,449,341 | 5/1984 | Taglianetti et al. | 52/235 |

*Primary Examiner*—Carl D. Friedman
*Assistant Examiner*—Michael Safavi
*Attorney, Agent, or Firm*—Robert A. Westerlund, Jr.

[57] ABSTRACT

This invention relates to a novel multiple-glazed vision and spandrel panel having vision and spandrel areas integral thereto, and a curtainwall system incorporating at least a plurality of these panels.

19 Claims, 3 Drawing Figures

MULTIPLE-GLAZED COMBINATION VISION AND SPANDREL ARCHITECTURAL PANEL AND CURTAINWALL

BACKGROUND OF THE INVENTION

I. Field of the Invention

This invention relates generally to architectural curtainwall systems, and more particularly, to a novel curtainwall system incorporating a plurality of architectural panels each having both vision and spandrel areas integral thereto.

II. Description of the Presently Available Technology

Most presently available window systems for glazing the exterior walls of buildings, i.e., curtainwall systems, have separate vision and spandrel architectural panels secured adjacent to each other by vertical and horizontal mullions mounting the edifice wherein the curtainwall system is installed. Representative examples of the present technology include U.S. Pat. No. 4,302,503 issued to Mattimoe, U.S. Pat. No. 3,951,525 issued to Ballentine, U.S. Pat. No. 4,233,796 issued to Mazzoni et al.

The vision architectural panels are characterized by having luminous or visible transmittances of at least about 5% and the separate spandrel architectural panels are characterized by luminous or visible transmittances of less than about 0.5%. Spandrel panels are principally employed to conceal those portions of a building that would not be aesthetically pleasing if capable of being viewed from the exterior of the building, including floor slabs, the vertical spans between successive viewing closures, heating and air conditioning convectors, plumbing and electrical conduits, and the like. Vision panels, on the other hand, generally include a transparent substrate, usually glass, sometimes having a transparent, reflective coating applied to a major surface thereof, which serves to reflect external light and heat incident upon the major surface to which it is applicated. Spandrel areas have been formed by the use of spandrel panels which are either intrinsically opaque or are transparent substrates, usually glass, having an opaque backing or coating material applied to a major surface thereof.

PPG Industries, Inc. manufactures and sells a glass panel under their trademark SPANDRELINE®. In PPG Industries "Architectural Data Handbook", Fifth Edition, pp. 28–31, the Spandreline® panel is described as follows:

> "This custom product enables the architect to use one piece of glass containing both the spandrel and vision area within the same panel. The colored spandrel area can be positioned anywhere on the panel . . . . Scattered pinholes and non-uniformity of color in the ceramic enamel will be apparent from indoors if Spandreline is used without backup material or closure of the same size and shape as the ceramic enameled areas."

Although the SPANDRELINE® glass panel is acceptable for its intended purpose, there are curtainwall designs where it would not be suitable. More particularly, because a monolithic panel is employed, the contrast between the vision area and the spandrel area is apparent, no matter how well the vision and spandrel area coatings are "color-matched", e.g., by the techniques taught in U.S. Pat. No. 3,951,525 issued to Ballentine. The major difficulty is that since no frame member is employed to conceal or obfuscate the line of demarcation at the interface of the vision area with the spandrel area, the interruption in color uniformity between the vision area and the spandrel area is obvious to an ordinary observer, especially under outdoor lighting conditions. In a curtainwall system, these aesthetic discontinuities are magnified.

Although the present technology is generally acceptable for providing a curtainwall having generally aesthetically harmonious vision and spandrel areas comprised of separate vision and spandrel panels, it would be advantageous to provide a curtainwall having aesthetically harmonious vision and spandrel areas, comprised of architectural panels having integral vision and spandrel areas and which would eliminate the drawbacks of the presently available panels and curtainwall systems.

SUMMARY OF THE INVENTION

The present invention relates to a multiple-glazed architectural panel having integral vision and spandrel areas. In a preferred embodiment, the panel includes a first and a second transparent substrate joined around their peripheries to define an insulating air space therebetween. A transparent, reflective coating is applied to either surface of the first substrate and a substantially opaque coating or backing, i.e., an opacifier is applied to a selected portion of either surface of the second substrate to provide both vision and spandrel areas integral to the second substrate. The transparent, reflective coating and the opacifier are selected to aesthetically harmonize the vision and the spandrel areas of the multiple-glazed panel to obfuscate the line of demarcation and the contrast which inherently exists at the interface of the vision and spandrel areas of the second substrate. The distance between the first and the second substrates, i.e., the insulating air space, serves or functions to further obfuscate the line of demarcation, and the contrast between the spandrel and the vision areas.

The present invention also relates to a curtainwall system for a structure, incorporating a plurality of the multiple-glazed combination vision and spandrel panels of this invention. With the curtainwall of this invention constructed of the combination vision and spandrel architectural panels of this invention, one horizontal mullion is eliminated wherever there is a separate spandrel panel with the curtainwalls presently in existence, thereby substantially reducing the total mullion area of the curtainwall, and thereby minimizing heat gain in the building due to conduction of heat through the metal mullions, without sacrificing color uniformity and aesthetic harmony between the vision and spandrel areas. Further, the number of glass panels which must be packaged, handled and installed is reduced by a number equivalent to the total number of spandrel areas in the structure, thereby significantly lowering packaging, handling, and installation costs, while making the tasks easier and faster.

DESCRIPTION OF PREFERRED EMBODIMENTS OF THE INVENTION

Figure 1:
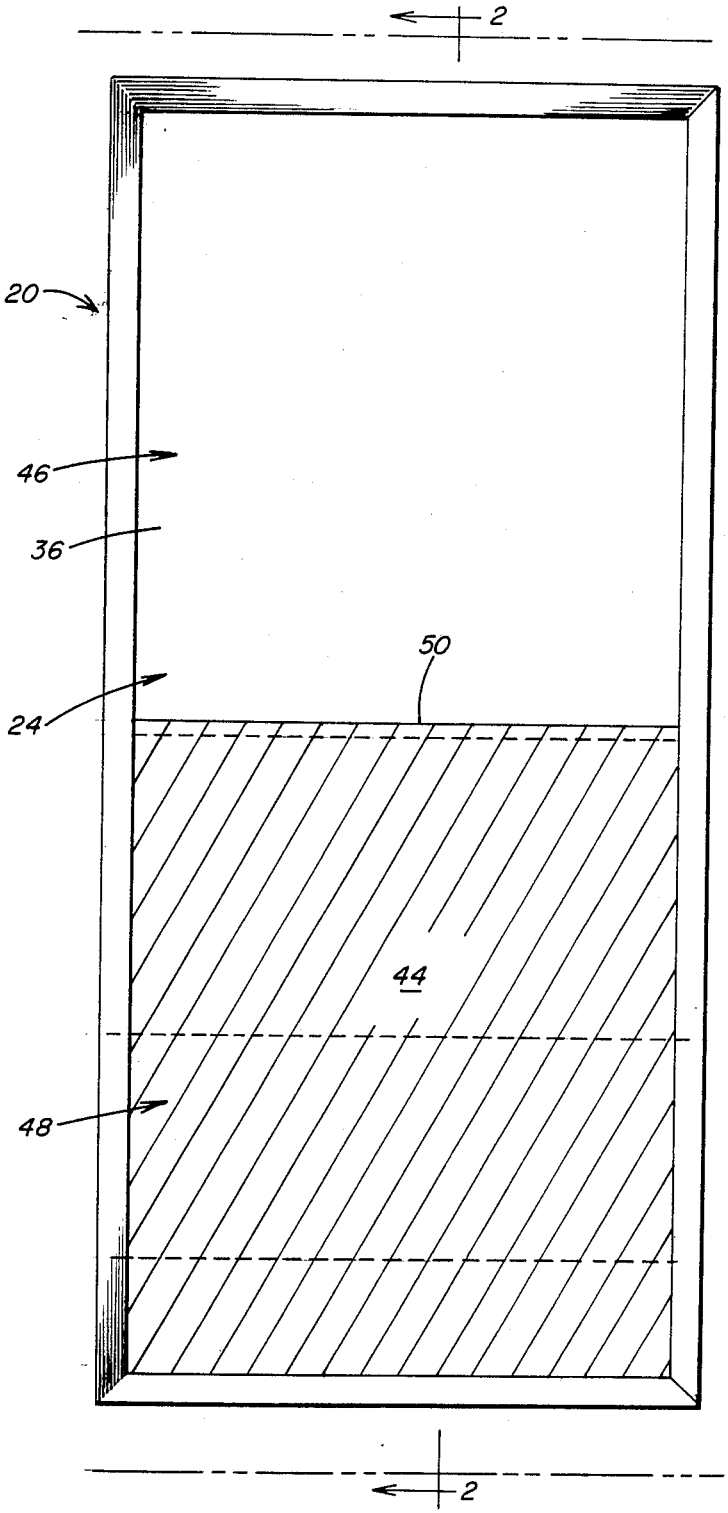
FIG. 1 is a rear elevational view of the preferred combination vision and spandrel architectural panel of this invention.

Referring now to FIG. 1, there can be seen the preferred embodiment of the multiple-glazed combination vision and spandrel architectural panel 20 of this invention. The vision and spandrel panel 20 preferably includes a pair of transparent substrates 24,26 held together in spaced, sealed relationship so as to define an insulating air space 22 therebetween. However, the number of substrates employed is not limiting to the invention, i.e., more than two substrates may suitably be used in the practice of this invention.

The transparent substrates 24,26 are preferably glass, with heat-strengthened soda-lime-silica glasses particularly preferred. The type or composition of the substrate or glass is not limiting to the invention.

Figure 2:
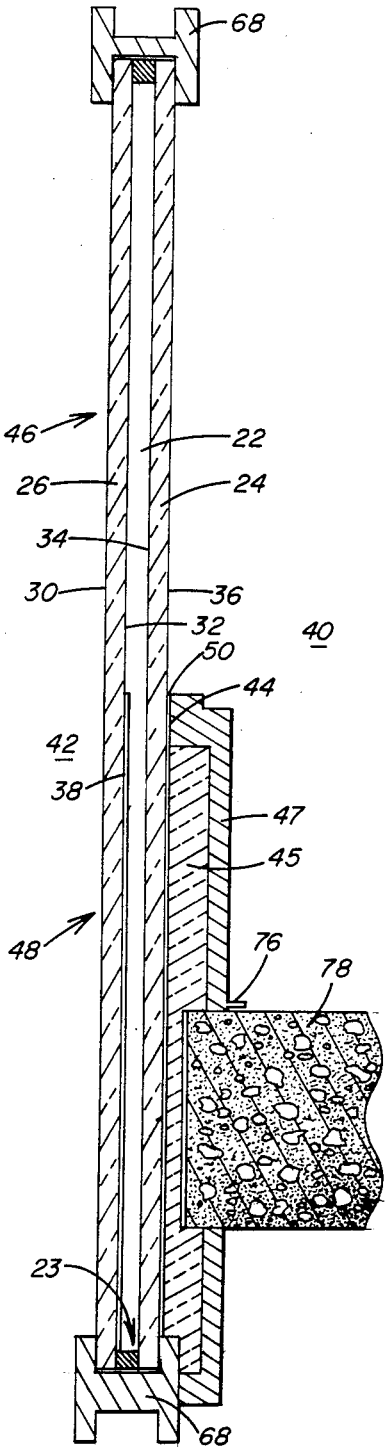
FIG. 2 is a fragmentary, sectional, elevational view, of a portion of the curtainwall construction shown in FIG. 3.

Referring additionally to FIG. 2, for purposes of the following discussion, the various surfaces of the inner substrate 24 and the outer substrate 26 will be referred to as follows. The outer surface 30 of the outer substrate 26, which is directly exposed to the outside environment, will be referred to as the No. 1 surface, the inner surface 32 of the outer substrate 26, which communicates with the air space 22, will be referred to as the No. 2 surface; the outer surface 34 of the inner substrate 24, which communicates with air space 22, will be referred to as the No. 3 surface; and the inner surface 36 of the inner substrate 24, which communicates with the interior 40 of the structure (shown in FIG. 3) wherein the panel 20 is to be installed, will be referred to as the No. 4 surface.

The vision and spandrel panel 20 further includes a transparent, reflective coating 38 applied to the No. 1 or No. 2 surfaces. In the preferred embodiment of the panel 20 shown in FIG. 1, the reflective coating 38 is substantially uniformly applied to substantially all of the No. 2 surface 32. The transparent, reflective coating 38 may suitably be a metal or metal oxide coating or may be a combination of films to produce interference colors. Although metal coatings are suitable, metal oxide coatings are preferable because of their durability. Any transparent, reflective metal or metal-oxide coating suitable for use in vision area glazing may be employed. The metal-oxide coatings preferred in the present invention include the oxides of tin, chromium, titanium, iron, silica, aluminum, nickel, lead, copper, zinc, vanadium, tungsten, tantalum and cobalt.

Coatings comprised of mixtures of oxides of two or more metals are also preferred. Basically, the preferability of a particular transparent, reflective coating for use in the practice of this invention is a direct function of its reflectivity, so that the greater the reflectivity of the coating, generally, the greater its preferability.

In a preferred embodiment of the panel 20 of this invention, the outer glass substrate 26 comprises a commercial float glass sheet having a copper and silver metallic oxide coating applied substantially uniformly over substantially all of the No. 2 surface 32, wherein the copper and silver metallic oxide coating exhibits an average reflectivity of approximately 45% of total solar energy and a transmittance of approximately 17% of total solar energy when viewed toward the No. 1 surface 30. The outer glass substrate 26 just described above is sold by PPG Industries, Inc. under their trademark SOLARBAN 575-20. However, as will be appreciated by those skilled in the art, any suitable transparent, reflective coating may be employed in the practice of this invention, as this is not a limiting feature of this invention. However, some typical properties of metal, or metal-oxide films/coatings when applied to a nominal 0.25 (0.635 cm) inch thick clear glass sheet are 6% to 44% reflectance of incident visible light (average daylight reflectance), 5% to 35% total solar infrared reflectance, and luminous transmittances of 5% to 35%. Reflectances given above are from the glass surface of the coated sheet.

Various methods may be used for substantially uniformly applying the transparent, reflective coating 38 to the surface selected for application of the coating 38. Methods for applying tin oxide films/coatings include the methods described in U.S. Pat. Nos. 2,566,346; 3,107,177; 3,185,586 and the like, which teachings are hereby incorporated by reference. Iron, cobalt, chromium and other metals of Groups IV, V, VI, VII, and VIII are preferably applied by pyrolization techniques as taught in U.S. Pat. Nos. 3,202,054; 3,081,200, and 3,660,061, which teachings are hereby incorporated by reference. Other techniques such as vacuum deposition and cathodic sputtering may also be employed to produce metal oxide films or coatings for use in the practice of this invention. Neither the type or composition of the reflective coating 38, nor the type or composition of the transparent substrates 34,36, the surface to which the coating 38 is applied, nor the manner or method of applying the coating 38 are limiting to this invention.

The vision and spandrel panel 20 further includes, an opaque coating or backing 44 applied to a selected portion only of the No. 3 or No. 4 surface, thereby forming a vision area 46 corresponding to the portion of the panel 20 to which no opaque coating or backing 44 is applied, and a spandrel area 48 corresponding to the selected portion of the panel 20 to which the opaque backing or coating 44 is applied. The opaque coating or backing 44 is preferably selected to have a dominant wavelength substantially equivalent to the dominant wavelength of light transmitted through the transparent, reflective coating 38, in order to aesthetically harmonize the vision area 46 and the spandrel area 48 of the vision and spandrel panel 20, with respect to color, reflectivity, and overall appearance, e.g., as is taught in U.S. Pat. No. 3,951,525 issued to Ballentine which teachings are hereby incorporated by reference. In the instant invention, harmonization is between the vision and the spandrel areas 46,48 of the same architectural panel 20, whereas the Ballentine patent teaches the aesthetic harmonization of separate vision and spandrel architectural panels. However, the same general principles in harmonization techniques taught by Ballentine are essentially practicable with the panel 20 of the present invention.

The opaque coating 44 may be a ceramic enamel which is durable and which can withstand abrasion during installation and temperature changes in use, without scratching or spalling. Glass frit enamels, e.g., lead borosilicate glass frit enamels, may be used effectively. Alumina, silica, boric acid, lead oxide, potassia and soda are typical constituents of suitable glass enamels. Other materials may also be present as constituents in the glass enamels employed. Some of these other constituents may include calcium oxide, barium oxide, zinc oxide, magnesium oxide, strontium oxide, and the like, as materials which contribute to the physical properties of the ceramic enamel. Other ingredients may also be present to impart color to the ceramic enamel (e.g., to simulate metal panelling) and to act as an opacifier. Such materials include titanium dioxide, cobalt oxide, the oxides of manganese, chromium, copper oxide, iron chromate, potassia dichromate, lead chromite and the like. The characteristics or properties of preferred opaque backings or coatings 44 include high reflectance of incident solar radiation, low absorption of solar radiation, and the quality of being opaque to the unaided eye, e.g., having luminous or visible transmittance of less than 0.8%; total solar ultraviolet transmittance of less than 0.2%; total solar infrared transmittance of less than 11%; and total solar energy transmittance of less than 6%. Typical opaque coatings also have a reflectivity of incident invisible light of between 15 to 50% and a reflectivity of incident infrared energy of between 20 to 80%. Higher infrared reflectance is desirable to prevent heat buildup in the spandrel area 48 with consequent air conditioning overloads and/or occasional glass fracture. U.S. Pat. No. 3,951,525 issued to Ballentine and U.S. Pat. No. 4,394,064 issued to Dauson teach suitable opaque ceramic enamel coatings and are hereby incorporated by reference.

Many methods are widely and commercially known for applying a substantially uniform opaque coating of ceramic enamel to a transparent substrate. A representative example of such a method is taught in U.S. Pat. No. 4,394,064 issued to Dauson, which teachings are hereby incorporated by reference. Of course, the Dauson teachings must be modified for practice with the present invention, insofar as the opaque coating 44 of this invention is applied to only a selected portion of the selected substrate surface.

Further, the opaque coating or backing 44 may suitably be an opaque laminate backing adhesively bonded to the appropriate panel surface, rather than a ceramic enamel coating as discussed above. In a prototype testing unit of the present invention, Mystik ER-250 black polyethylene tape having a solvent base adhesive, was used as the opaque backing 44. However, many other types of opaque laminate backings may be suitably employed in the practice of this invention, as the type of opaque coating or backing 44 used is not limiting to this invention. Other types of suitable opaque coatings include paint, polyethylene, polyester, or aluminum foil, among others. The preferred characteristics or properties of opaque laminate backings used in the practice of this invention are substantially the same as those of opaque ceramic enamel coatings.

Whether the opaque coating or backing 44 comprises a laminate backing or a ceramic enamel coating, a line of demarcation 50 will occur at the interface of the vision area 46 and the spandrel area 48 of the vision and spandrel panel 20. The selection of a transparent, reflective coating 38 having high reflectance properties, and the selection of an opaque coating or backing 44 having reflectance characteristics dictated by the transmittance characteristics of the transparent, reflective coating 38 so as to achieve aesthetic harmony between the vision area 46 and the spandrel area 48 will minimize or obfuscate the contrast and the line of demarcation 50 between the vision area 46 and the spandrel area 48, especially when the panel 20 is viewed towards the No. 1 surface under outdoor lighting conditions. As the distance between the opaque coating or backing 44 and the No. 1 panel surface 30 increases, the more the line of demarcation 50 is obfuscated, to thereby render the panel 20 more aesthetically pleasing for incorporation into a curtainwall system.

An adhesive can be applied to the exposed surface of the opaque backing 44, to which can be securely adhered an insulating mat or layer 45 for insulating the interior of the building into which the panel 20 is installed from heat gain due to heat absorption and subsequent heat transfer by the opaque backing 44 to the interior 40 of the building. The insulating mat or layer 45 may be applied either at a series of spaced points or as a continuous layer over the opaque backing 44. The insulation 45 preferably comprises a fibrous material or a foamed resin composition, e.g., fiber glass, builders' felt, asbestos fibers, urethane foam, or the like. Although the vision and spandrel panel 20 of this invention has been discussed as having the transparent, reflective coating 38 applied to either the No. 1 surface 30 or the No. 2 surface 32, it should be understood that the transparent reflective coating 38 may alternatively or additionally be applied to the No. 3 surface 34 or the No. 4 surface 36. In the event that the No. 3 surface 34 or the No. 4 surface 36 is selected, the outer substrate 26 would preferably be a tinted or colored glass, e.g., any of the tinted glasses sold by PPG Industries, Inc. under their trademarks SOLARBRONZE®, SOLARGRAY® or SOLEX®. The reason for employing a tinted or colored glass for the outer substrate 26 if the reflective coating 38 is applied to either of the No. 3 or No. 4 surfaces, is to increase or maximize the obfuscation of the line of demarcation 50 and the contrast between the vision area 46 and the spandrel area 48 of the panel 20. Generally speaking, it is believed that the tinted glass selected should minimize visible light transmittance therethrough to thereby minimize the visibility of the inner substrate 24 and its integral vision and spandrel areas 46,48, respectively. The SOLARBRONZE® glass exhibits the following visible light transmittances for the various thicknesses indicated: 57% (13/64 inch or 0.516 cm), 38% ($\frac{3}{8}$ inch or 0.953 cm), and 29% ($\frac{1}{2}$ inch or 1.27 cm). SOLARGRA® glass exhibits 19% visible light transmittance at $\frac{1}{2}$ inch or 1.27 cm thickness. SOLEX® glass exhibits a visible light transmittance of 64% at $\frac{3}{8}$ inch or 9.53 cm thickness. However, although low visible light transmittance is a preferred property or characteristic of the tinted glass, this property must be balanced with the desire to achieve aesthetic harmony between the outer substrate 26 and the inner substrate 24, and more particularly, it is preferable to match as closely as possible the dominant wavelength of the light transmitted through the outer substrate 26 with the dominant wavelength of the transparent, reflective coating 38, as hereinbefore discussed more thoroughly.

Figure 3:
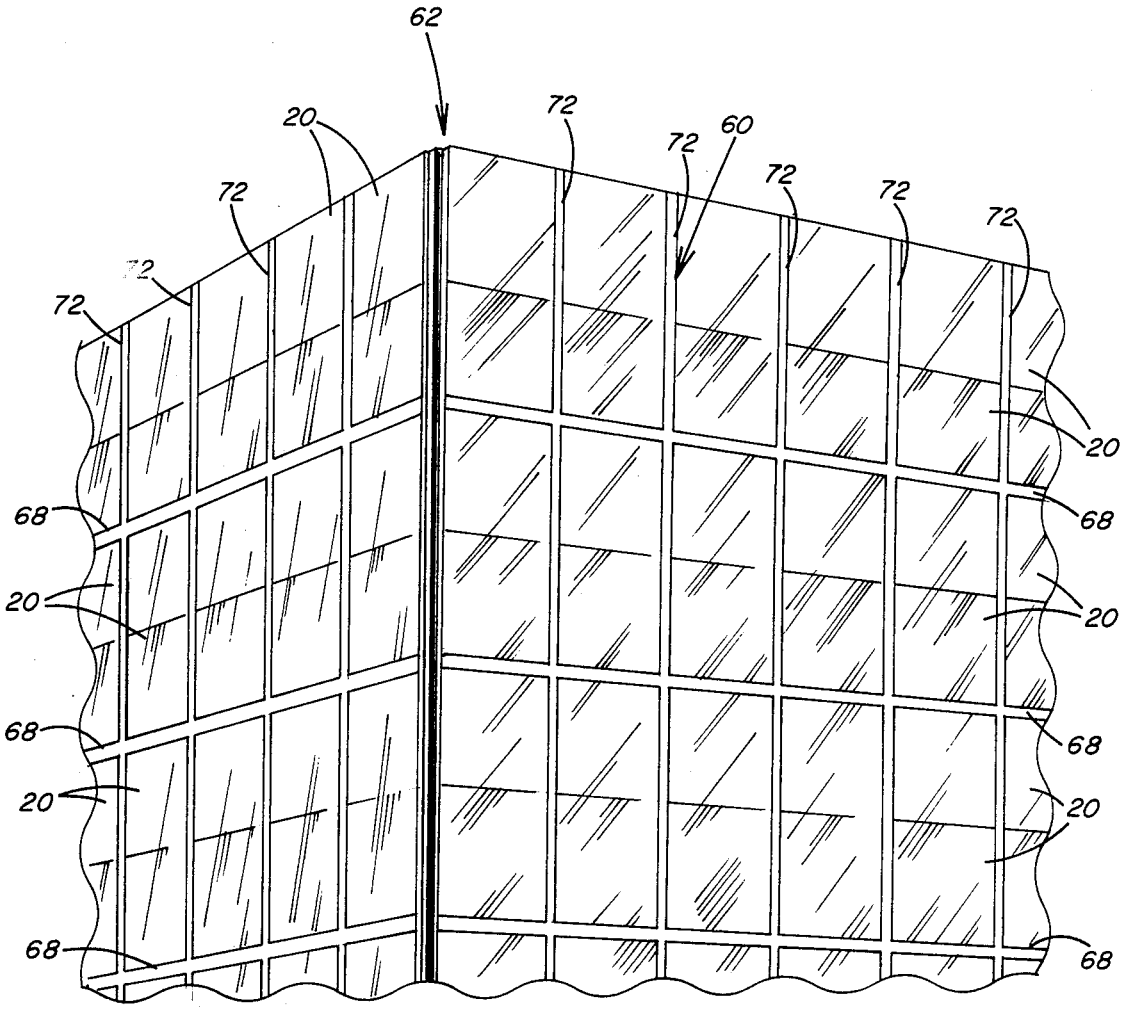
FIG. 3 is a fragmentary perspective view of a building curtainwall embodying features of the preferred curtainwall of this invention.

A glass curtainwall 60 in accordance with this invention, forming the exterior wall of the building 62 is depicted in FIG. 3 constructed of the vision and spandrel panels 20 of this invention securely joined together in any suitable manner, as is known in the pertinent art. Each vision and spandrel panel 20 is preferably mounted in horizontal frame members 68 at its top and bottom ends, and vertical frame members 72 along its entire left and right sides. The frame members 68 and 72 are each rigidly connected to a mounting 76 which is supported on a structural member 78 of the building 62. A floor (not shown) which is mounted on the structural member 78 faces the wall area of each frame member in the panel 20, so that, preferably, the edge of the floor, the structural member, the mounting, any material between the floor level and the next lower ceiling, and the cross-section of the ceiling, are hidden from exterior view by the spandrel area 48 of the panel 20, and anything between the floor and beneath the next highest ceiling is viewable from the exterior through the vision area 46 of the panel 20 of the present invention. The horizontal frame members 68 are referred to as horizontal mullions, and the vertical frame members 72 are termed vertical mullions in the architectural field.

The manner and means employed to construct the curtainwall 60 of this invention is not limiting to this invention. However, it is preferable that at least a plurality of the panels constituting the curtainwall 60 be made in accordance with the teachings of this invention, although the type and configuration of the panels employed in the curtainwall 60 are not limiting to the invention. The curtainwall 60 constructed with the panels 20 of this invention has the benefit and advantage of reduced mullion and energy costs (by elimination of many horizontal mullions and the energy cost savings attendant thereto), reduced handling and installation costs (fewer panels to handle and install), expediting of the curtainwall construction process, and increased architectural design flexibility, without sacrifice in color uniformity and aesthetic harmony between the vision and spandrel areas.

The following are examples of tested embodiments of the panel of this invention, a discussion of test results, and an elaboration of various aspects of this invention.

EXAMPLES

Four test units or samples embodying features of this invention were prepared. Sample Nos. 1–4 were prepared using double-glazed window units sold by PPG Industries, Inc. under their trademarks SOLARBAN 575-20®, SOLARBAN 560-14®, SOLARBAN 550-20®, and SOLARBAN 570-30®, respectively. All of the test units were about 34 inches (86.36 cm)×76 inches (193 cm) with a ½ inch (1.27 cm) insulating air space. Each of the test units has an opaque laminate backing applied to about the lower one-third portion of the No. 4 surface 36 of the inner substrate 24 and a transparent, reflective coating applied to the No. 2 surface 32 of the outer substrate 26. In each of the test units, the opaque laminate backing employed comprised black polyethylene adhesive tape having a solvent base adhesive, sold under the trademark MYSTIK ER-250®, applied to the No. 4 surface 36 after the No. 4 surface 36 was thoroughly cleaned without leaving a detergent film thereon. In each of the test units, the inner substrate 24 comprises ¼ inch (0.64 cm) thick clear float glass and the outer substrate 26 comprises ¼ inch (0.64 cm) thick clear float glass with a factory-applied transparent, reflective coating applied to the No. 2 surface 32 thereof. The composition of the reflective coating is as follows for the four test units, or samples:

Sample No. 1: SOLARBAN 575-20®—copper and silver;

Sample No. 2: SOLARBAN 560-114®—stainless steel;

Sample No. 3: SOLARBAN 550-20®—nickel; and

Sample No. 4: SOLARBAN 570-30®—titanium.

The four vision and spandrel test units thus constructed were viewed with the unaided eye, under outside lighting conditions, on a partly sunny day. The test unit No. 1 constructed with the SOLARBAN 575-20, which has a reflectivity of 45% of total solar energy and a transmittance of 17% of total solar energy, (hereinafter referred to as TSE) appeared to the observer to be the most aesthetically pleasing with regard to non-noticeability of the contrast between the vision area 46 and the spandrel area 48 of the vision and spandrel panel 20; the next most aesthetically pleasing was subjectively determined to be the test unit No. 2 constructed with the SOLARBAN 560-14®, which has a reflectivity of 28% of TSE and a transmittance of 11% of TSE; the next most aesthetically pleasing was subjectively determined to be the test unit No. 3 constructed with the SOLARBAN 550-20 which has a reflectivity of 18% of TSE and a transmittance of 17% of TSE; and the least aesthetically pleasing of the test units was the one (No. 4) constructed with the SOLARBAN 570-30 which exhibits a reflectivity of 15% of TSE and a transmittance of 24% of TSE. However, even the last-mentioned test unit (No. 4) was found to be aesthetically acceptable, to the observer, with regard to the non-noticeability or obfuscation of the contrast and the line of demarcation 50 between the vision area 46 and the spandrel area 48 of the unit. Further, although the noticeability of the line of demarcation 50 is generally inversely related to the reflectivity of the transparent, reflective coating, (i.e., less noticeable the greater the reflectivity) the transmittance characteristics of the reflective coating are also contributorily determinative of the desirability of the transparent, reflective coating for purposes of concealing or obfuscating the vision area and spandrel area contrast, and more particularly, the greater the transmittance of the reflective coating, generally the more noticeable is the vision and spandrel contrast, which is aesthetically undesirable. Further, the contrast becomes less visible to the outside observer as the observer's line of sight deviates from a line normal to the No. 1 surface of any of the units. At angles less than approximately 60 degrees to the No. 1 surface, the contrast becomes substantially indiscernible or invisible, including at angles of 60 degrees or less looking upwardly at the No. 1 surface or laterally at angles less than 60 degrees from the No. 1 surface, for example.

Further tests were conducted on all four vision and spandrel panels in order to determine the magnitude of the thermal stresses produced in the innermost glass panel 24 at the interface of the vision area 46 with the spandrel area 48 and at the edges of the panels, due to the discontinuity of the No. 4 surface attendant to the application of the opaque backing 44 over the lower one-third portion of the No. 4 surface. Essentially, the concentrated, relatively high buildup of heat in the opaque backing 44 in contrast to the relatively low absorption of heat in the upper two-thirds portion of the No. 4 surface not covered by the opaque backing 44, causes a thermal imbalance in that glass panel, thereby generating thermal stresses in the panel, which stresses are at a maximum at the edges of the panel. However, in the four vision and spandrel units tested with regard to this phenomena, the thermal stresses were found to be acceptable, even under the most strenuous tests to which they were subjected, as is clearly discernible from the following table:

RESULTS OF HEAT LAMP THERMAL STRESS TESTS WITH TEST PANELS 1-4 HAVING 2 INCH (5.08 CM.) INSULATION AGAINST SPANDREL

| Sample No. | Avg. Temp. at No. 1 Surface °F. (°C.) | Temp. Across Vision/Spandrel Interface °F. (°C.) on No. 4 Surface Centerline | Edge | Maximum: Stresses, psi* (Tensile) Nastran | Strain Gage |
|---|---|---|---|---|---|
| | | 16 LAMP TEST | | | |
| 4 | 180.7 (82.61) | 60.0 (15.55) | 3.5 (−15.83) | 3880 | 3917 |
| 3 | 181.0 (82.77) | 51.7 (10.94) | 3.0 (−16.11) | — | 3977+ |
| 2 | 178.8 (81.55) | 49.3 (9.61) | 2.7 (−16.27) | 3611 | 3885 |
| 1 | 165.7 (74.27) | 30.9 (−.61) | 0.5 (−17.50) | — | 2784+ |
| | | 28 LAMP TEST | | | |
| 4 | 258.0 (125.55) | 86.8 (30.44) | 4.7 (−15.16) | 6565 | 6185 |
| 3 | 253.7 (123.16) | 78.5 (25.83) | 2.9 (−16.16) | — | 5515+ |
| 2 | 259.4 (126.33) | 80.2 (26.77) | 4.4 (−15.33) | 6515 | 6153 |
| 1 | 226.0 (107.77) | 46.3 (7.94) | 1.5 (−16.94) | — | 3668+ |

+Estimated from stress values versus temperature data for No. 1 and No. 3 samples.
*The thermal stresses were found to be acceptable with heat strengthened glass.

In order to facilitate easy and accurate interpretation of the above chart, it will now be explained as follows with respect to the test unit No. 2. Under the 16 Lamp Test, with a 2 inch (5.08 cm) thick insulation layer 45 adhesively bonded to the opaque backing 44, and an average temperature imposed on the No. 1 surface of the panel 20 of 178.8° F. (81.5° C.), a difference in temperature of 49.3° F. (9.61° C.) was recorded on the No. 4 surface of the unit between points at a distance of 1 inch (2.54 cm) above and 1 inch (2.54 cm) below the interface or line of demarcation 50 between the vision area 46 and the spandrel area 48 of the panel 20, as measured along the vertical center line of the No. 4 surface and a 3.5° F. (−15.83° C.) temperature difference was measured between the corresponding points on the edges of the No. 4 surface, and wherein further, the maximum stress on the inner glass substrate 24 of the panel 20, which occurs at the edges thereof, was calculated via the NASTRAN method at 3,611 psi and measured via the strain gage method at 3,885 psi. The strain gage method for measuring thermal stress in a glass sheet basically involves the use of an electrical apparatus which is responsive to resistance increases due to increased thermal stress at the edges of the glass sheet being stress-measured, as is known in the art to which this invention pertains, and the NASTRAN test involves the processing of glass temperature data by a NASA computer program designed for calculating thermal stresses in a glass sheet based upon a multiplicity of temperature readings taken at a corresponding multiplicity of predetermined points or locations throughout the glass sheet as is also known and used in the pertinent art.

It will be understood from this disclosure and from the claims that the present invention is not limited to the particular embodiments previously discussed and described herein to illustrate this invention. Accordingly, the present invention embraces equivalent embodiments which will become apparent to those skilled in the art from this disclosure and which are embraced by the following claims.

What is claimed is:

1. A multiple-glazed combination vision and spandrel architectural panel, comprising:

a first transparent monolithic substrate having first and second surfaces;

a second transparent monolithic substrate having third and fourth surfaces;

means for joining said first substrate and said second substrate to define an insulating air space therebetween;

a transparent, reflective coating applied to one of said first or said second surfaces;

an opacifier applied to a selected portion of one of said third or said fourth surfaces to provide a vision area and a spandrel area integral to said second substrate; and wherein said transparent, reflective coating and said opacifier are selected to aesthetically harmonize said first and second substrates when the panel is viewed toward said first surface of said first substrate.

2. The panel as set forth in claim 1, wherein a line of demarcation is formed at the interface of said vision area and said spandrel area, and a contrast exists between said vision area and said spandrel area, and wherein further, said transparent, reflective coating and said insulating air space combinatorially serve to obfuscate said line of demarcation and said contrast when the panel is viewed toward said first surface of said first substrate.

3. The panel as set forth in claim 2, wherein said opacifier is characterized by a dominant wavelength substantially equivalent to the dominant wavelength of light transmitted through said transparent, reflective coating, to aesthetically harmonize said first and said second substrates of the panel.

4. The panel as set forth in claim 3, wherein said opacifier is a ceramic enamel coating.

5. The panel as set forth in claim 4, wherein said transparent, reflective coating is a metal coating.

6. The panel as set forth in claim 4, wherein said transparent, reflective coating is a metal oxide coating.

7. The panel as set forth in claim 3, wherein said opacifier is an adhesive laminate backing.

8. The panel as set forth in claim 6, wherein said reflective coating is a metal oxide coating selected from any of the oxides of cobalt, iron, chromium, copper, manganese, nickel and silver.

9. The panel as set forth in claim 8, wherein said ceramic enamel coating is selected from any member of the group comprising lead borosilicate, alumina, silica, boric acid, lead oxide, potassia and soda.

10. The panel as set forth in claim 9, wherein said first and said second substrates are glass substrates.

11. The panel as set forth in claim 10, wherein at least said second substrate is a heat strengthened glass substrate.

12. The panel as set forth in claim 4, wherein said transparent, reflective coating has a visible light reflectivity of from about 30% to about 40% and an infrared reflectivity of from about 25% to about 35% and said ceramic enamel coating has a visible light reflectivity of from about 20% to about 40% and an infrared reflectivity of from about 25% to about 45%, to further aesthetically harmonize said first and said second substrates of the panel.

13. The panel as set forth in claim 12, wherein said ceramic enamel coating has a luminous transmittance of less than about 1% and said transparent, reflective coating has a luminous transmittance of at least about 5%.

14. The panel as set forth in claim 10, wherein said first substrate is a colored or tinted glass substrate.

15. The panel as set forth in claim 14, wherein said transparent, reflective coating is applied to one of said third or fourth surfaces.

16. The panel as set forth in claim 15, wherein the visible light transmittance of said colored/tinted first substrate is between about 10% to about 60%.

17. The panel as set forth in claim 16, wherein the dominant wavelength of said transparent, reflective coating applied to said third or fourth surface is nearly equal to the dominant wavelength of said colored/-tinted first substrate.

18. The panel as set forth in claim 3, wherein said insulating air space is at least about ½ inches (1.27 cm).

19. The panel as set forth in claim 3, wherein said air space is at least about 1 inch (2.54 cm).

* * * * *